US008167298B2

(12) United States Patent
Ueda et al.

(10) Patent No.: US 8,167,298 B2
(45) Date of Patent: May 1, 2012

(54) SHEET FEEDING DEVICE AND IMAGE FORMING APPARATUS PROVIDED THEREWITH

(75) Inventors: Daisuke Ueda, Tokyo (JP); Akira Kosugi, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 132 days.

(21) Appl. No.: 12/267,647

(22) Filed: Nov. 10, 2008

(65) Prior Publication Data

US 2009/0121410 A1 May 14, 2009

(30) Foreign Application Priority Data

Nov. 13, 2007 (JP) ..... 2007-294136

(51) Int. Cl.
*B65H 3/14* (2006.01)

(52) U.S. Cl. ..... 271/98

(58) Field of Classification Search ..... 271/97, 271/98

See application file for complete search history.

(56) References Cited

U.S. PATENT DOCUMENTS 5,645,274 A * 7/1997 Ubayashi et al. ..... 271/94
5,921,544 A * 7/1999 Benedict ..... 271/226

FOREIGN PATENT DOCUMENTS

| | | |
|---|---|---|
| EP | 1785375 A1 | 5/2007 |
| JP | 60-52428 | 3/1985 |
| JP | 60-52429 | 3/1985 |
| JP | 5-107969 A | 4/1993 |
| JP | 5-270676 | 10/1993 |
| JP | 6-219578 | 8/1994 |

OTHER PUBLICATIONS

Extended European Search Report for European Application No. 08168522.4-1256/2060518 dated Jun. 27, 2011.

* cited by examiner

*Primary Examiner* — Michael McCullough
(74) *Attorney, Agent, or Firm* — Cantor Colburn LLP

(57) ABSTRACT

A sheet feeding device includes: a sheet feeding tray adapted to stack a sheet bundle including a plurality of sheets thereon; a blowing section which blows air against a leading edge of the sheet bundle in a sheet conveyance direction from a front side of the sheet conveyance direction; a sticking and conveying section which sticks an uppermost sheet stacked on the sheet feeding tray by air sucking, and feeds the uppermost sheet to a conveyance roller; a sucking duct provided inside the sticking and conveying section, which is divided into a plurality of ducts in the sheet conveyance direction; and an intercepting member which intercepts at least one of the plurality of divided ducts.

5 Claims, 10 Drawing Sheets

SHEET FEEDING DEVICE AND IMAGE FORMING APPARATUS PROVIDED THEREWITH

This application is based on Japanese Patent Application No. 2007-294136 filed on Nov. 13, 2007, which is incorporated hereinto by reference.

BACKGROUND OF THE INVENTION

The present invention relates to a sheet feeding device used for an image forming apparatus such as a copying machine, a printer, a facsimile machine, a printing machine and a multi-function peripheral, and in particular, to a sheet feeding device that can separate sheets having a strong sticking power between the sheets such as coated sheet one sheet by one sheet surely, and can feed out them.

On the image forming apparatus, there is provided a sheet feeding device that feeds out sheets with a sheet feeding roller one sheet by one sheet from a bundle of sheets wherein a plurality of sheets are stacked. In the sheet feeding device of this kind, if plural sheets are fed simultaneously on a multi-feeding basis, it causes sheet jamming. Further, if conveyance power is small, it tends to cause misfeeding. Therefore, there has been devised a way to feed out one sheet by one sheet surely. Namely, the misfeeding is prevented by feeding out the uppermost one sheet of the stacked sheets, by making the coefficient of friction between a sheet feeding roller and a sheet. Further, for preventing that two or more sheets are fed out simultaneously, second sheet and thereafter are pushed back through separation operations by means of a separation roller, a separation pad or a separation claw, so that the uppermost one sheet only may be fed out.

This method is effective as far as ordinary sheets only are used. In recent years, however, use application for a copying machine and a printer is expanded, and types of sheets to be used including coated sheet have been diversified. Some of these various types of sheets show strong sticking power between the sheets when they are stacked, and they sometimes make it difficult to prevent multi-feeding surely on the aforesaid sheet feeding device.

Therefore, there has been suggested a method wherein a blowing outlet is provided on the side of the conveyance direction for stacked sheets, so that air may blow from the blowing outlet against plural sheets positioned to be in an upper part of the superposed sheets in their thickness direction, to separate sheets by causing air to pass through clearances between sheets.

However, a coated sheet has a characteristic to stick to other coated sheet firmly under the high humidity environment. A bundle of sheets stuck firmly is a heavy mass for slow wind velocity, thus, it is impossible for soft air blowing from a lateral side to separate stuck sheets and to cause a sheet to rise to the surface.

For solving this problem, it is considered to make the air blowing to raise the sheet to be more powerful. However, even when airflow is made to be more powerful, separation of sheets into a single sheet is not improved, though sheets are pushed up greatly.

With the foregoing as a background, Unexamined Japanese Patent Application Publication No. 60-52428 suggests a constitution having therein a sheet sticking conveyance section that attracts one sheet from a bundle of sheets supported by a sheet superposing device through suction of air to convey the sheet and a blowing section that blows air against an upper portion of the bundle of superposed sheets in the conveyance direction from a leading edge of the sheet. By blowing air in the direction from the front side of the sheet, it is possible to lift several sheets in the bundle of superposed sheets, and to attract the uppermost sheet only with the sheet sticking and conveyance section, to convey. After the uppermost one sheet is attracted by the sheet sticking and conveyance section, air blowing from the front side acts to separate the second sheet and thereafter.

In the sheet sticking and conveyance section of this kind, a pump which is generally for a small capacity and for high pressure is used for suction. However, in case of attracting a thick sheet, a large-sized pump should be used to acquire sufficient airflow. Thus, there have been problems that noise grows greater, and plural sheets are attracted to cause multi-feeding in case of thin sheets.

Therefore, in the constitution in Unexamined Japanese Patent Application Publication No. 60-52428, a pump which is for a large capacity and for low pressure and a pump which is for a small capacity and for high pressure are provided to be used by switching depending on sheet quality, to cope with the aforesaid problems.

However, the method in Unexamined Japanese Patent Application Publication No. 60-52428 has a problem of cost increase, because two sets of pumps are required. Therefore, in Unexamined Japanese Patent Application Publication No. 06-219578, a measuring instrument for measuring suction power and a measuring instrument for measuring blowing power are arranged respectively in a sucking duct and a blowing duct to control rotation of a motor for the sucking duct and to control rotation of a motor for the blowing duct, based on their measured values. By doing this, sucking power and blowing power can be stabilized.

Further, Unexamined Japanese Patent Application Publication No. 60-52429 suggests a constitution having a valve provided in a sucking duct, wherein a period of time from the moment when a sucking device starts its suction up to the moment when a sheet is stuck is measured, and when this period of time is long, sucking power is raised by enlarging an aperture amount of the valve, while, when this period of time is short, sucking power is lowered by lowering the aperture amount of the valve.

Further, Unexamined Japanese Patent Application Publication No. 05-270676 suggests a constitution having a damper in a sucking duct, wherein timing for opening and closing the damper is changed to cope with a size and a thickness of a sheet.

Now, a sheet stuck to a sticking and conveying section is conveyed, and its leading edge is nipped by a conveyance roller, and then, is fed into an image forming section by the conveyance roller. When a size of a sheet is small, it happens that a trailing edge of the sheet is positioned at the middle of the sucking duct, and a part of the sucking duct is not covered by the sheet when the leading edge of the sheet is nipped by the conveyance roller. After the leading edge of the sheet has been nipped, the sticking and conveying section can be stopped, but the sheet is required to be conveyed by the sticking and conveying section until the moment when the leading edge of the sheet is nipped by the conveyance roller. During the period when the sheet is conveyed by the sticking and conveying section, the sticking duct is required to continue sticking. In that case, a portion of the sucking duct which is not covered by the sheet sucks the succeeding sheet to cause multi-feeding, during the period from the moment when a trailing edge of a sheet passed the rear end of the sucking duct up to the moment when a leading edge of the sheet is nipped by the conveyance roller, which is a problem.

However, a method to solve this problem is not described in the aforesaid Unexamined Japanese Patent Application Publications Nos. 60-52428, 06-219578, 60-52429 and 05-270676. In this case, it is considered that a dimension of the sucking duct is made to be small, adjusting to the smallest size of a sheet conveyed by a sheet feeding device. However, when doing so, sucking power lacks and causes conveyance defects in the case of a large-sized sheet.

SUMMARY OF THE INVENTION

An objective of the invention is to solve the aforesaid problems, and further objective is to provide a sheet feeding device capable of conveying sheets independently of their sizes by preventing multi-feeding, and to provide an image forming apparatus employing the sheet feeding device.

To achieve the aforesaid objects, a sheet feeding device of the invention has therein a sheet feeding tray on which a sheet bundle composed of a plurality of sheets is placed, a blowing section that blows air against a leading edge of the sheet bundle in the sheet conveyance direction from a front side of the sheet conveyance direction, a sticking and conveying section that sticks an uppermost sheet in the aforesaid sheet bundle placed on the sheet feeding tray by air sucking, one sheet by one sheet, and feeds the sheet into a conveyance roller, sucking ducts provided in the sticking and conveying section and are divided into plural ones in the sheet conveyance direction and an intercepting member that intercepts at least one of sucking ducts divided into plural ones.

To achieve the aforesaid objects, an image forming apparatus of the invention has therein an image forming section that forms a toner image on an image carrier, a transfer section that transfers the toner image on the image carrier onto a sheet, a sheet feeding device that conveys the sheet to the transfer section and a fixing device that heats and fixes the aforesaid sheet on which a toner image is formed, and, the sheet feeding device has therein a sheet feeding tray on which a sheet bundle composed of plural sheets is placed, a blowing section that blows air against a leading edge of the sheet bundle in the sheet conveyance direction, a sticking and conveying section that sticks an uppermost sheet in the aforesaid sheet bundle placed on the sheet feeding tray, one sheet by one sheet, and feeds the sheet into a conveyance roller, sucking ducts provided in the sticking and conveying section and are divided into plural ones in the sheet conveyance direction and an intercepting member that intercepts at least one of sucking ducts divided into plural ones.

Figure 6:
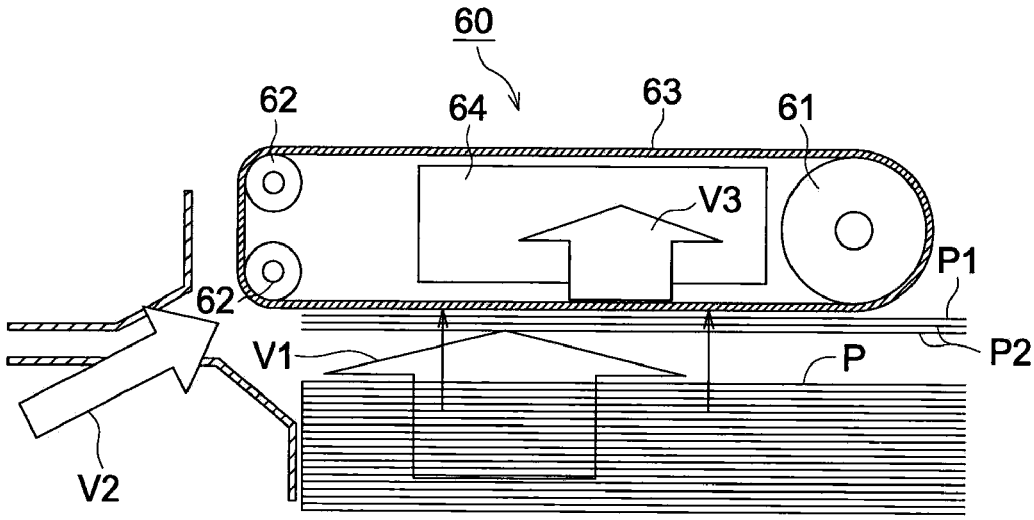
Figure 6:
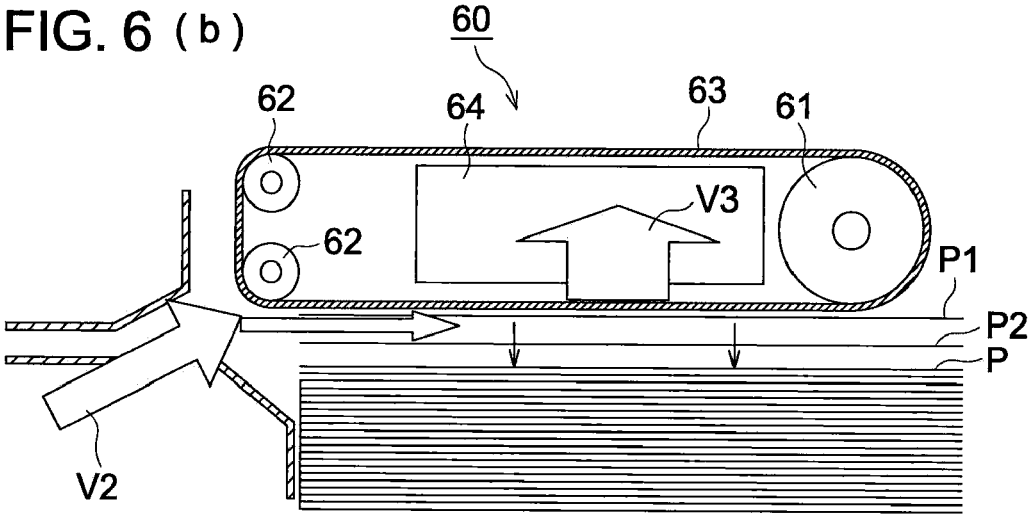

Each of FIGS. 6(*a*) and 6(*b*) is a sectional view showing sticking and conveying process of a sheet by a side blowing section and a blowing section, and FIG. 6(*a*) shows sheet sticking process and FIG. 6(*b*) shows sheet separation process.

Figure 7:
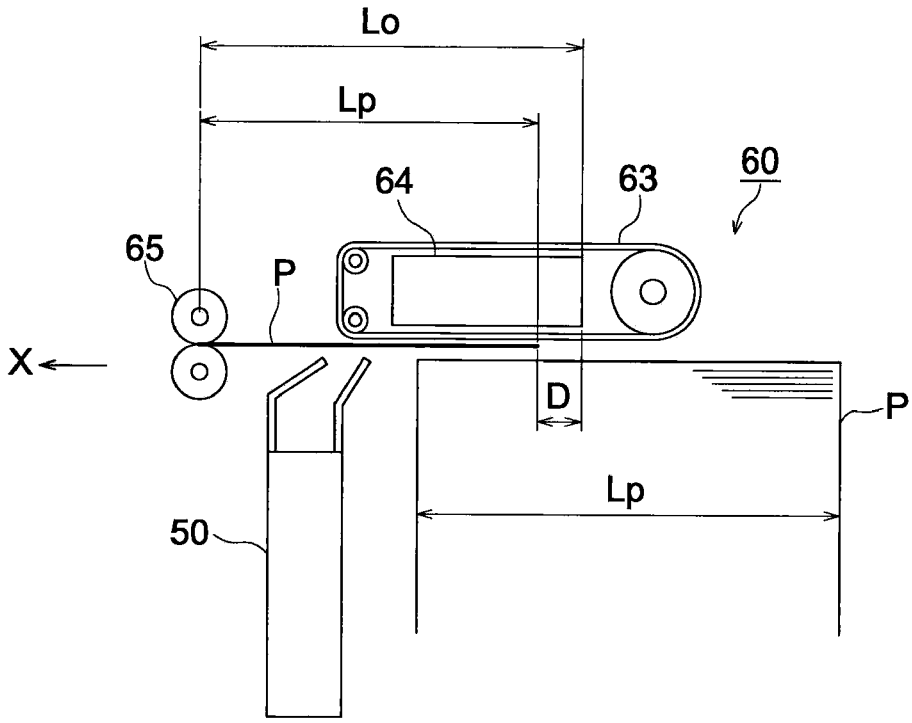
Figure 7:
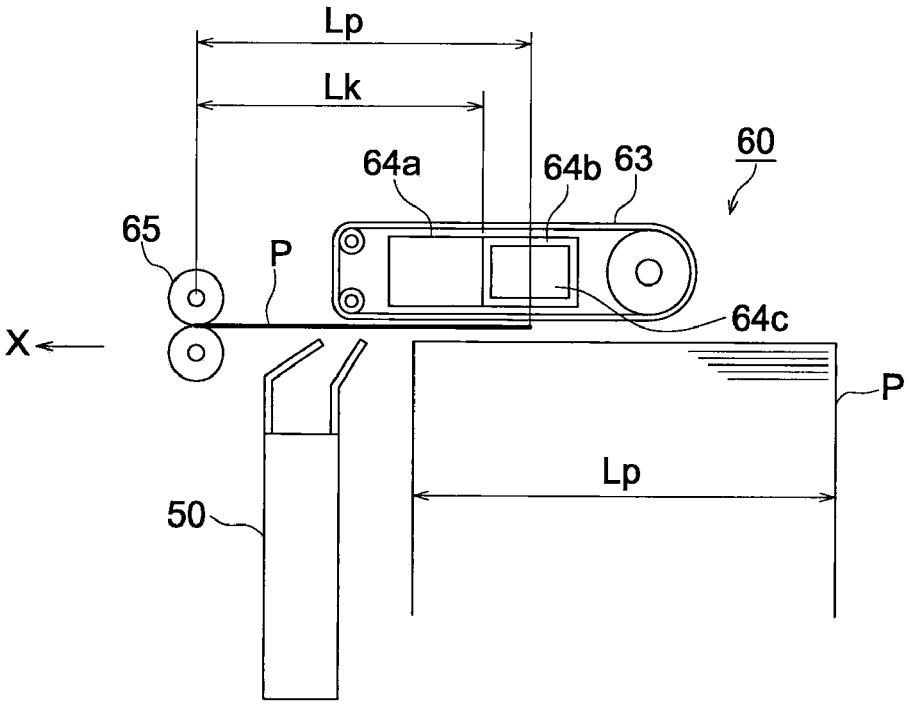

Each of FIGS. 7(*a*) and 7(*b*) is a diagram illustrating relationship between a sucking duct and a sheet length, and FIG. 7(*a*) shows an occasion where the sucking duct is not divided and FIG. 7(*b*) shows an occasion where the sucking duct is divided in the example of the invention.

Figure 8:
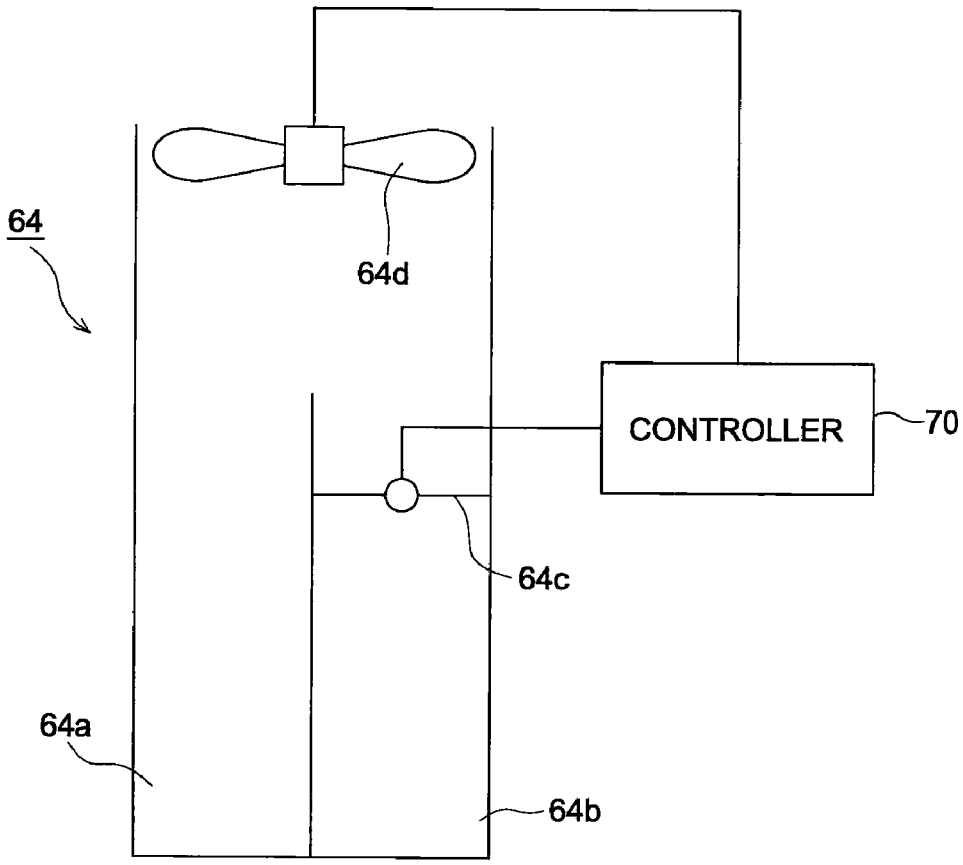

FIG. 8 is a plan view showing schematically the constitution of a divided suction device.

Figure 9:
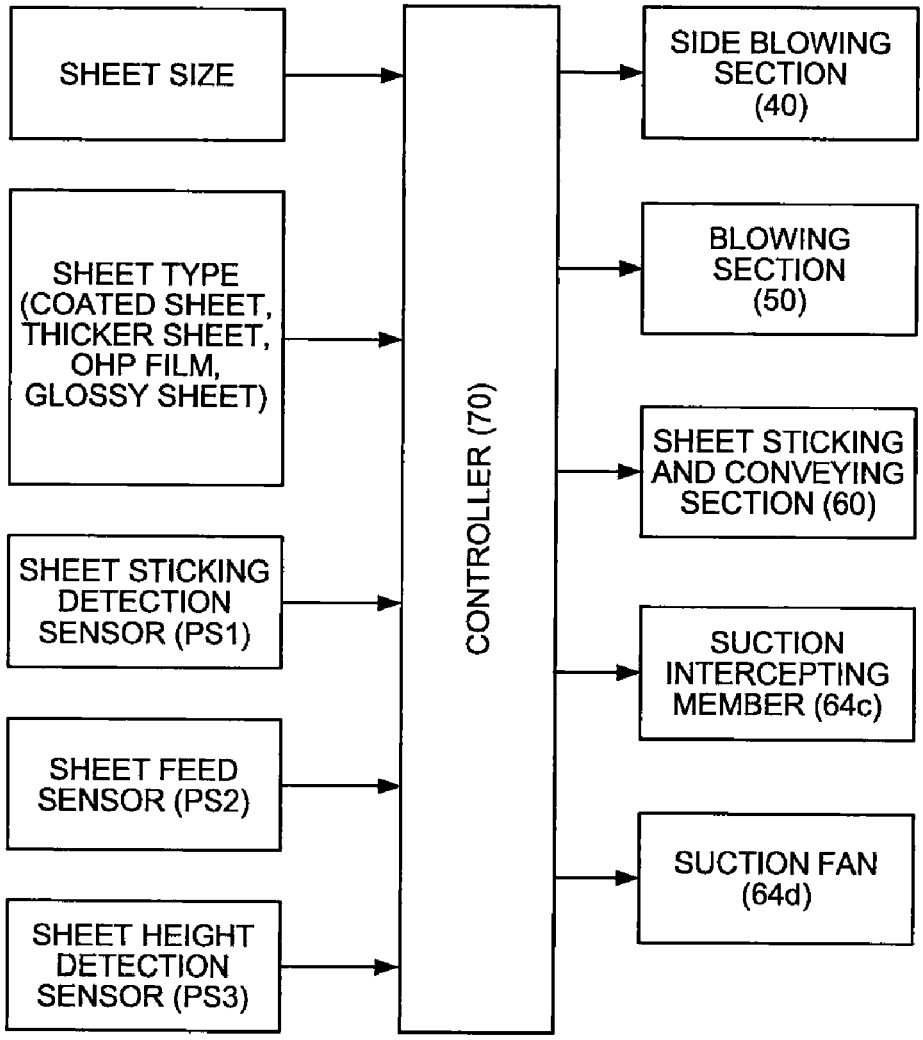

FIG. 9 is a block diagram showing the constitution of a control of a sheet feeding device.

Figure 10:
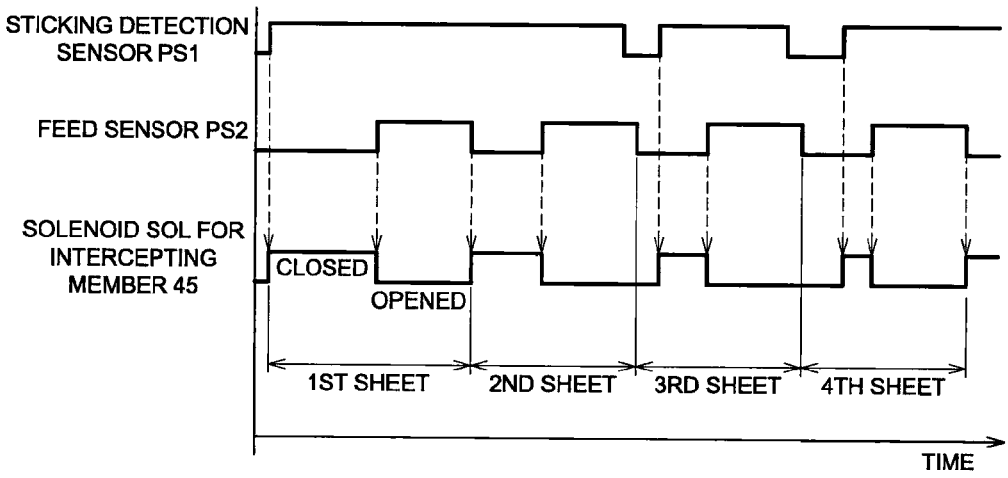

FIG. 10 is a timing chart showing control of a sheet feeding device.

DETAILED DESCRIPTION OF THE PREFERRED EMBODIMENT

Referring to the drawings, there will be explained an embodiment of the invention, to which, however, the invention is not limited.

An embodiment of the invention will be explained as follows, referring to the drawings.

[Image Forming Apparatus]

Figure 1:
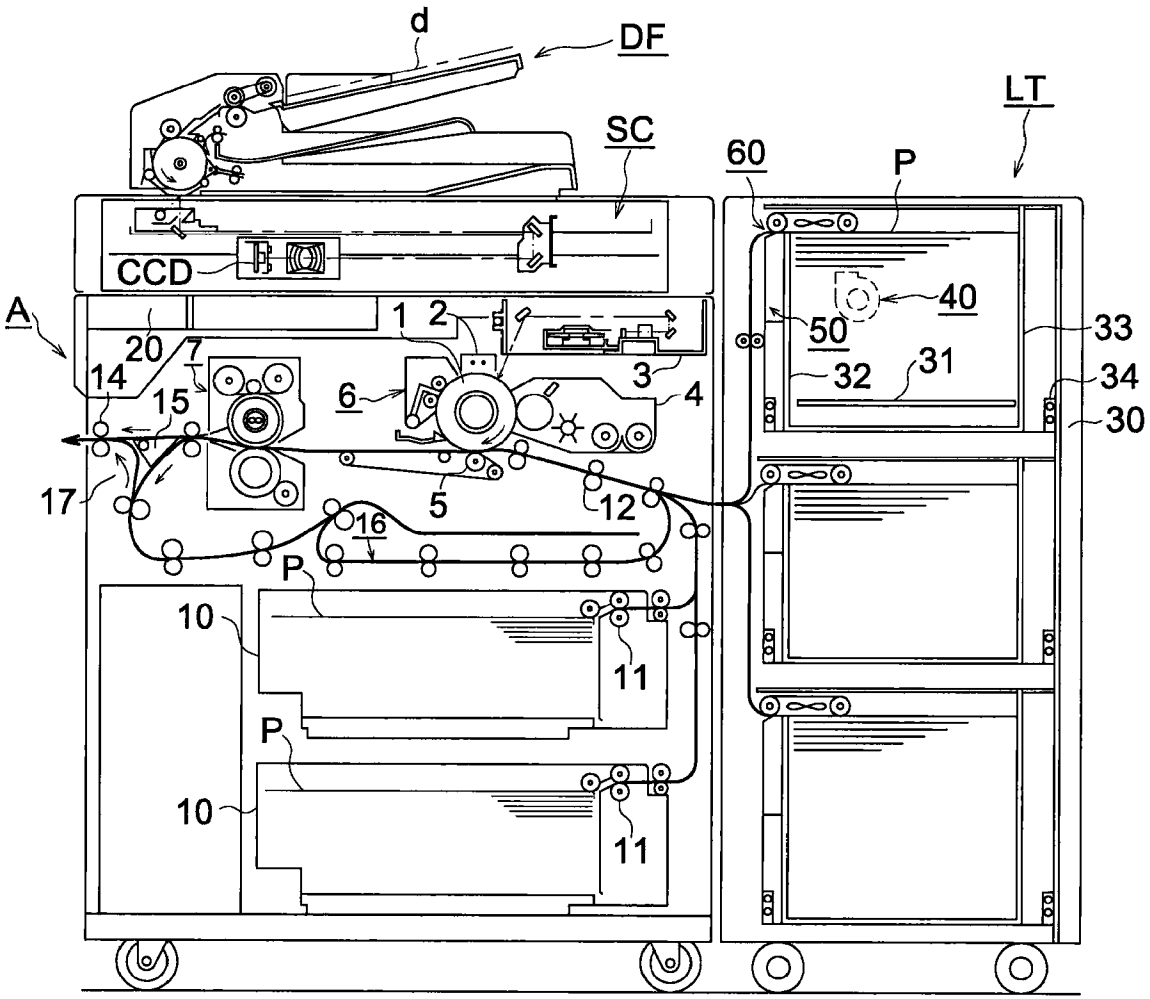
FIG. 1 is an overall structure diagram of an image forming apparatus that is composed of an image forming apparatus main body, an image reading device, an automatic document feeder and of a large capacity sheet feeding tray.

FIG. 1 is an overall structure diagram of an image forming apparatus that is composed of image forming apparatus main body A, image reading device SC, automatic document feeder DF and of large capacity sheet feeding tray LT.

Illustrated image forming apparatus main body A is composed of an image forming section having therein photoreceptor 1 representing an image carrier, charging section 2, imagewise exposing device 3, developing device 4, transfer section 5 and cleaning section 6, fixing device 7 and of a sheet conveying section.

The sheet conveying section is composed of sheet cassette 10, first sheet feeding section 11, second sheet feeding section 12, sheet ejection section 14, conveying path switching section 15, sheet circulating and re-feeding section 16 and sheet reversing and ejecting section 17.

Document "d" placed on a document platen of automatic document feeder DF is conveyed by a sheet feeding section, then, images on one side or on both sides of document "d" are given exposure by an optical system of image reading device SC, and are read by image sensor CCD. Analog signals resulted from photoelectric transduction conducted by image sensor CCD undergo analog processing, A/D conversion, shading correction and image compression processing in image processing section 20, and image signals are sent to imagewise exposing device 3.

In the image forming section, there are conducted processes including charging, imagewise exposure, developing, transfer, separation and cleaning.

In the image forming section, a surface of photoreceptor 1 is charged by charging section 2, and irradiation of laser beam from imagewise exposing device 3 forms an electrostatic latent image which is visualized by developing device 4 to become a toner image. Then, sheet P housed in sheet cassette 10 is conveyed from the first sheet feeding section 11. The sheet P is synchronized with the toner image in second sheet feeding section 12 composed of a registration roller, to be conveyed. After that, the toner image is transferred onto the sheet P in transfer section 5, to be fixed by fixing device 7.

The sheet P after fixing processing is ejected by sheet ejection section 14 to the outside of the apparatus. On the other hand, residual toner remaining on photoreceptor 1 after transfer processing is removed by cleaning section 6. Incidentally, in the case of two-sided copying, sheet P having an image on its first surface is fed into sheet circulating and re-feeding section 16 to be reversed, and is ejected to the outside of the apparatus by sheet ejection section 14 after an image is formed again on the second surface in the image forming section. In the case of reversal sheet ejection, sheet P branched from an ordinary sheet ejection path is turned inside out in sheet reversing and ejecting section 17 on a switchback basis, and is ejected to the outside of the apparatus by sheet ejection section 14.

Large capacity sheet feeding tray LT representing a sheet feeding device of the invention is connected to image forming apparatus main body A. The sheet feeding tray LT has therein sheet feeding device main body 30, side blowing section 40, blowing section 50 and sticking and conveying section 60, and houses therein large quantities of sheets P to feed sheet P to image forming apparatus main body A one sheet by one sheet.

The sheet feeding device main body 30 has therein sheet tray 31, leading edge regulating member 32, trailing edge regulating member 33 and guide rail 34. The sheet tray 31 is constructed to be in three steps, and each sheet tray 31 is constructed so that it may be drawn out of the sheet feeding tray LT by guide rail 34. The maximum amount of sheet feeding of the sheet feeding tray LT is about 10,300 sheets.

Figure 2:
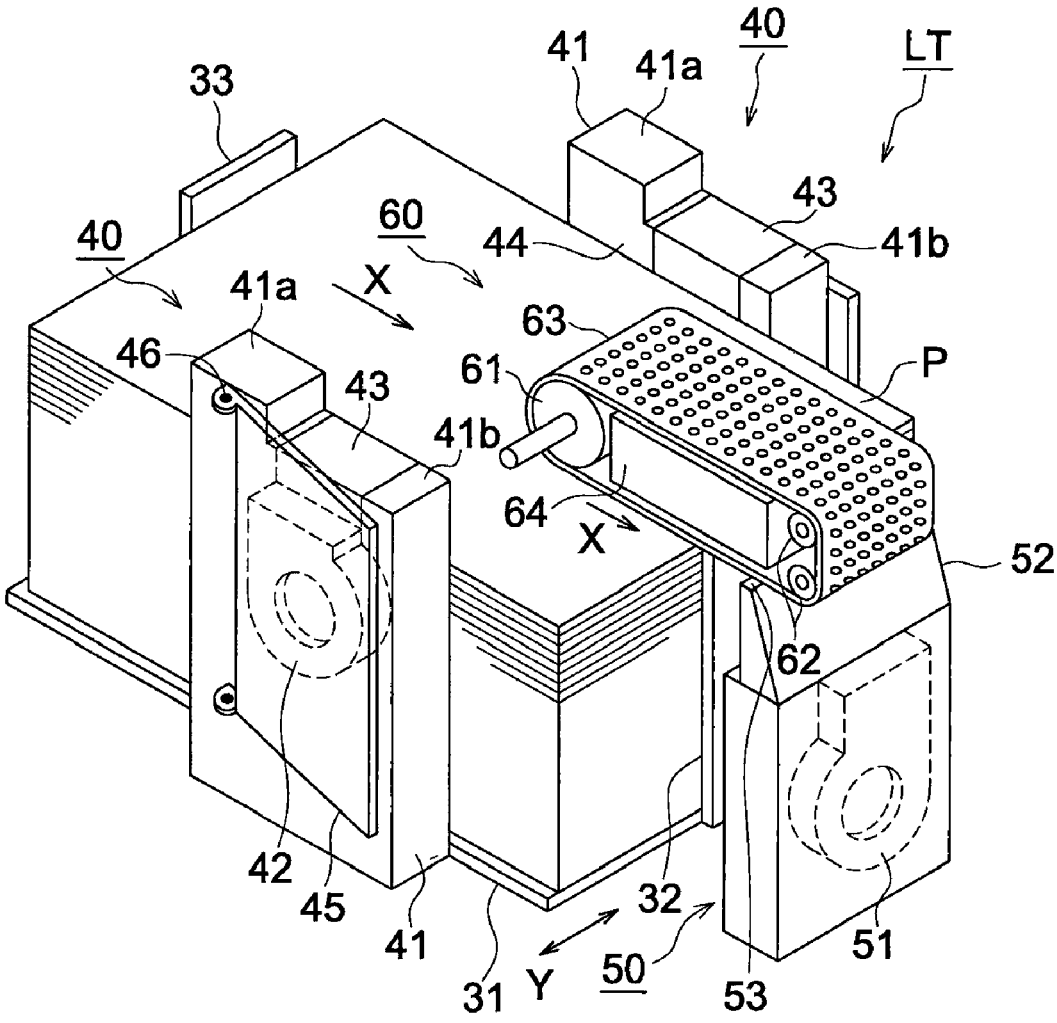
FIG. 2 is a perspective view showing primary parts of a sheet feeding device of the invention.
Figure 3:
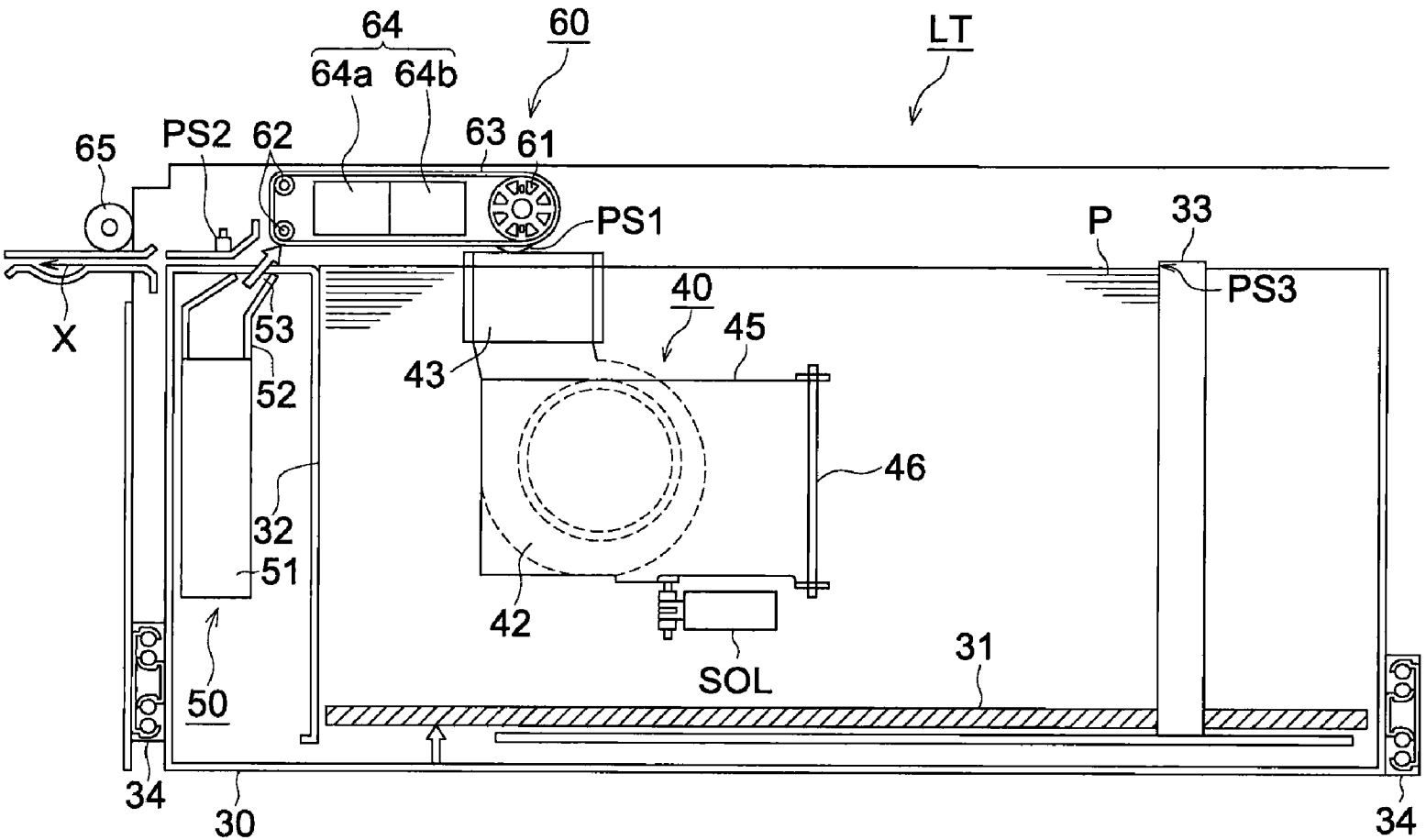
FIG. 3 is a front section view of a sheet feeding device.
Figure 4:
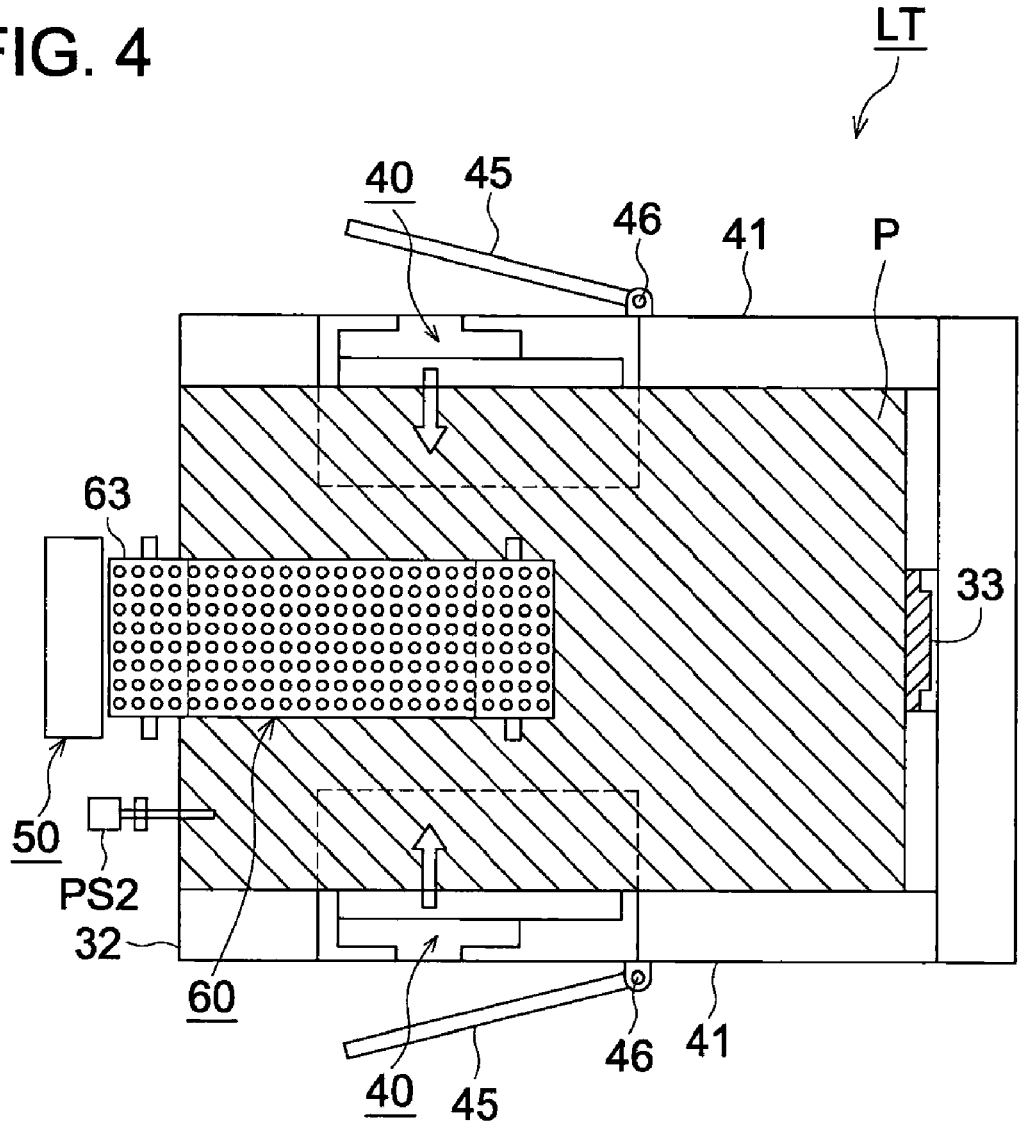
FIG. 4 is a plan view of a sheet feeding device.
Figure 5:
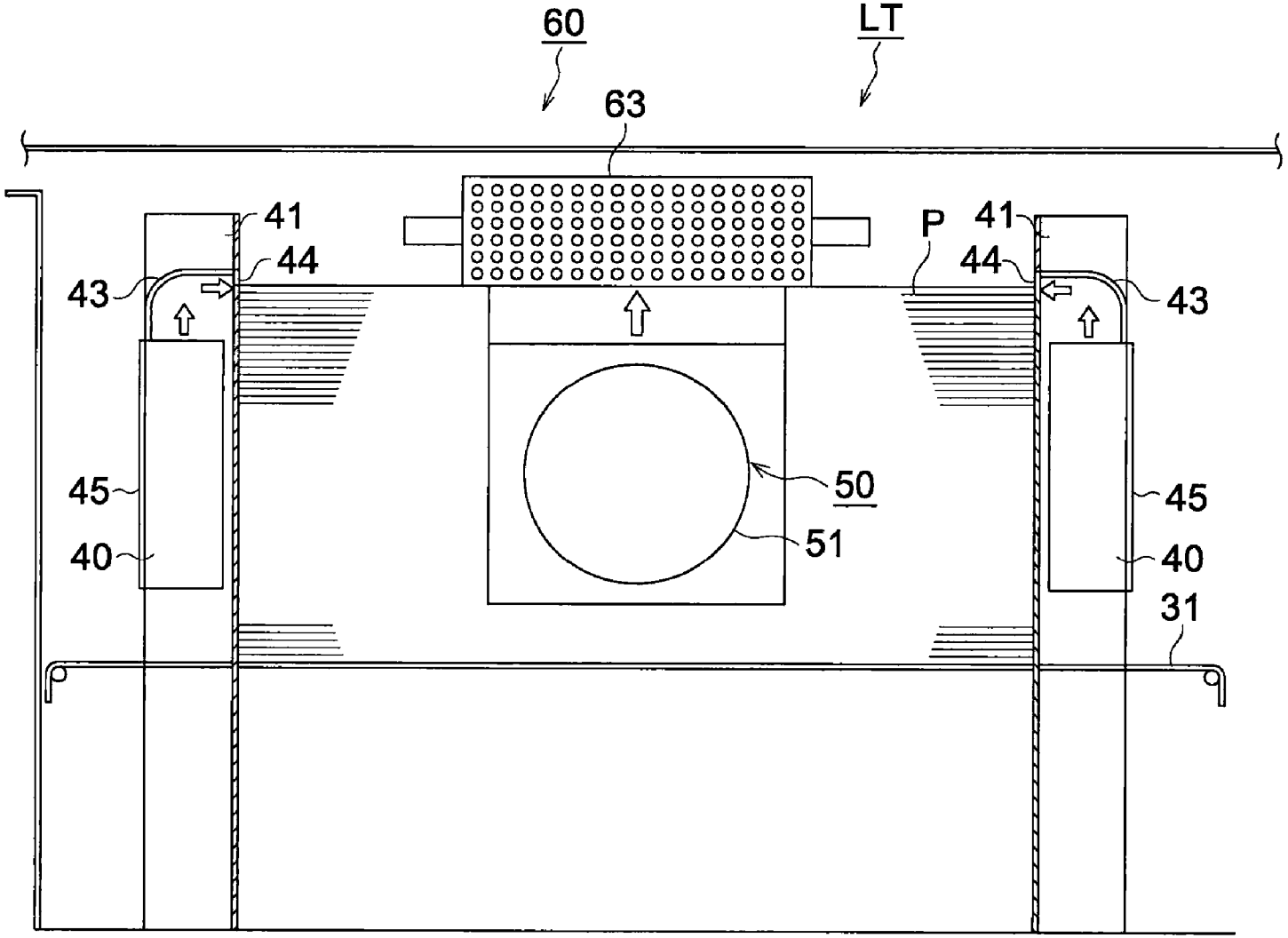
FIG. 5 is a side view of a sheet feeding device.

FIG. 2 is a perspective view showing primary parts of a sheet feeding tray of the invention, FIG. 3 is a front section view of sheet feeding tray LT, FIG. 4 is its plan view and FIG. 5 is its side view.

In these drawings, superposed sheets P are placed on sheet tray 31, and they are housed to be capable of rising and falling through an unillustrated mechanism. Side regulating member 41 is movable freely in the lateral direction of a sheet, and it slightly presses both sides of sheets P to regulate positions of both sides of sheet P, depending on a sheet width for superposed sheets P. The side regulating member 41 has steps on its top portion, and surface 41*a* of the steps positioned on an upstream side in the conveyance direction for sheet P is higher, and surface 41*b* positioned on a downstream side is lower. On the surface 41*a* on the upstream side, there is attached a supporting member that supports an upper end of the side regulating member 41, though this is not illustrated. In the sheet conveyance direction, an area where surface 41*b* on the downstream side is provided and an area where sticking and conveying section 60 described later is provided overlap each other on the sheet conveying direction (direction of arrow X in FIG. 2). Thus, when sheet tray 31 is drawn out in the direction of arrow Y in FIG. 2 in the case of sheet feeding, surface 41*b* on the downstream side can pass through the lower part of sticking and conveying section 60.

Leading edge regulating member 32 regulates a position of a leading edge of sheet P in the conveyance direction for the sheet. Trailing edge regulating member 33 is movable freely in the conveyance direction for sheet P, and it regulates a position of the trailing edge of sheet P in its conveyance direction.

As shown in FIG. 3, on the trailing edge regulating member 33, there is arranged height detection sensor PS3 that detects a height of the uppermost sheet P.

Controller in FIG. 9 described later controls to drive an unillustrated elevating motor and to raise sheet tray 31, based on results of detections by height detection sensor PS3, so that a height of a bundle of sheets stacked on sheet tray 31 may keep an optimum height for conducting air blowing and blowing of sheet P.

As shown in FIG. 3, in the vicinity of the leading edge of sheet P in the direction of feeding out for sheet P, there is arranged sticking and conveying section 60. The sticking and conveying section 60 has sticking belt 63 that is entrained about large roller 61 connected to a driving source and about two small rollers 62, and rotates. On the sticking belt 63, there are bored many through holes each having a small diameter. Inside the sticking belt 63, there is arranged suction device 64 that conveys sheet P while sucking the sheet P through the sticking belt 63, to send sheet P to sheet feeding roller 65.

Suction device 64 is divided into two sucking ducts 64*a* and 64*b* in the conveyance direction (direction of arrow X) for sheet P. The sucking ducts 64*a* and 64*b* can be switched between an occasion to suck with only sucking duct 64*a* and an occasion to suck with both sucking ducts 64*a* and 64*b*. Details of these two sucking ducts 64*a* and 64*b* will be described in detail later.

As shown in FIG. 2 and FIG. 5, side blowing section 40 that blows air against an upper portion of superposed sheets P in sheet tray 31 in the side direction perpendicular to the conveyance direction for sheet P, is arranged on each of both sides of sheet tray 31. The side blowing section 40 has a blowing fan 42 that blows air against an upper portion of sheets P from blowing outlets 44 positioned at both sides in the direction perpendicular to the conveyance direction for sheet P. The blowing outlets 44 is positioned at surface 41*b* that is at the downstream side of side regulating member 41, and is arranged so that at least a part thereof may overlap with sticking and conveying section 60, in the sheet conveyance direction (direction of arrow X). Namely, as shown in FIG. 3, a portion at a tip side of the blowing outlet 44 is drawn to be under the sticking belt 63.

Since the side blowing section 40 is provided in the side regulating member 41, the side blowing section 40 can also be moved together by moving the side regulating member 41, even when a size of sheet P is changed. Meanwhile, though side blowing sections 40 are provided on both sides of sheet P in the present example, it is also possible to provide side blowing section 40 on one side.

The side blowing section 40 is driven, thereby, air is blown against a lower portion of sticking and conveying section 60 from the blowing outlet 44, thus, air is blown against several sheets positioned at an upper part of superposed sheets P. Air passes through a clearance between sheets from an end portion of sheet P on its one side to be blown against an end portion on the other side. Owing to this, several sheets at an upper portion of sheets P are separated into independent sheets. Uppermost sheet P of sheets P separated in this way sticks to the sticking and conveying section 60.

Sticking detection sensor PS1 arranged in the vicinity of a sticking surface of sticking belt 63 detects that the uppermost surface of sheet P has been stuck to the sticking belt 63. Then, the sticking belt 63 starts rotating to start conveying sheet P.

Feed sensor PS2 arranged in the vicinity of the sticking belt 63 on the downstream side of sheet tray 31 in the sheet conveyance direction detects passage of sheet P to be fed.

In the vicinity of a tip portion of the sticking belt 63 at the downstream side of sheet tray 31 in the sheet conveyance direction, blowing section 50 is fixed on sheet feeding device main body 30. The blowing section 50 is composed of blowing fan 51 and others. Meanwhile, the blowing section 50 may also be constructed so that the blowing section 50 is attached on the sheet feeding device main body 30 to blow air against a tip portion of a bundle of sheets through a duct.

Blowing fan 51 of the blowing section 50 is attached with its blowing outlet 53 facing upward. Air that is blown upward is changed in terms of its direction by guide plate 52, to be blown out upward obliquely from the blowing outlet 53, and it blows against the vicinity of the sticking belt 63 of the sticking and conveying section 60.

Blowing section 50 is controlled in terms of driving, depending on types of sheet P. Namely, for occasions such as OHP film, tracing paper, coated paper having smooth surface, sheet with perforated lines or streaks and offset-printed sheet coated with sword powder, air is blown into a clearance between sheets so that separation is carried out surely.

When the sticking belt 63 continues rotating while sucking sheet P, the uppermost sheet P of a bundle of sheets advances in the illustrated direction of arrow X, and is nipped by sheet feeding rollers 65 to be sent to image forming apparatus main body A.

As shown in FIGS. 2 and 3, an air inlet of side blowing section 40 is intercepted by intercepting member 45 to be free for opening and closing. Namely, the intercepting member 45 composed of a plate-shaped shutter is supported on shaft 46, and is opened or closed by solenoid SOL. A controller controls opening and closing of the intercepting member 45, and controls air blowing by side blowing section 40, in a way to switch between on (blowing) and off (stop).

Each of FIG. 6(*a*) and FIG. 6(*b*) is a sectional view showing process of sticking and conveying for a sheet by side blowing section 40 and blowing section 50. For the purpose of explaining a principle of sticking, an explanation will be given with suction device 64 which is not divided.

FIG. 6(*a*) shows a process of sheet sticking. A small number of sheets P in the upper layer of a bundle of sheets stacked on sheet tray 31 are lifted against their deadweight by side way blowing V1 (illustrated outline arrow) blown up by side blowing section 40, and are sucked by suction V3 (illustrated outline arrow) by negative pressure of sticking belt 63. Front way blowing V2 (illustrated outline arrow) blown up by blowing section 50 blows against the vicinity of the front bottom portion of the sticking belt 63.

FIG. 6(*b*) shows a sheet separation process. When a small number of sheets P in the upper layer of a bundle of sheets are stuck to the sticking belt 63, the intercepting member 45 intercepts an air inlet of side blowing section 40 to stop air blowing. Then, air blowing by blowing section 50 only passes through a clearance between sheet P1 in the uppermost layer and sheet P2 that is lower than sheet P1. The sheet P1 in the uppermost layer is sucked by suction V3 of sticking and conveying section 60, and is separated from sheets P of a bundle of sheets excluding the sheet P1 in the uppermost layer. Sheet P2 that is lower than the separated sheet P1 in the uppermost layer descends with its deadweight in the direction of an arrow to be housed on sheet P.

By repeating air blowing by side blowing section 40 and by blowing section 50, lifting of sheets P in several sheets on upper part of a sheet bundle spreads to almost entire surfaces of blowing outlets 44 and 53, and clearances between sheets become equal substantially. Thus, air passes through these clearances. Owing to this, separation of sheet P1 is improved and it becomes easy to send out sheet P1. This solves problems that lifting of sheet P1 becomes too great to damage sheets and that plural sheets are lifted while they are stuck to each other, and fail to be separated.

After completion of separation of sheet P1 from sheet P2, an unillustrated driving section for sticking and conveying section 60 starts driving, whereby, one sheet of sheet P1 stuck to the sticking belt 63 is conveyed to sheet feeding roller 65.

Each of FIG. 7(*a*) and FIG. 7(*b*) is a diagram explaining relationship between a sucking duct and a sheet length, and FIG. 7(*a*) shows an occasion where the sucking duct is not divided, while, FIG. 7(*b*) shows an example of the invention in which the sucking duct is divided. FIG. 8 is a plan view showing schematically the structure of divided suction device 64.

There will be explained an occasion wherein suction device 64 is not divided as shown in FIG. 7(*a*). As explained in each of FIG. 6(*a*) and FIG. 6(*b*), suction device 64 is provided inside sticking belt 63 of sticking and conveying section 60, and a bottom surface of suction device 64 sucks sheet P through holes on sticking belt 63. The sheet P thus sucked is conveyed in the direction of X when sticking belt 63 rotates. After the leading edge of sheet P is nipped by sheet feeding roller 65, sticking belt 63 stops, and sheet P is conveyed by rotation of sheet feeding roller 65. That is, when the leading edge of sheet P is nipped by sheet feeding roller 65, sticking belt 63 stops.

In the case of Lo>Lp, when Lp represents a length of sheet P in its conveyance direction, and Lo represents a distance from sheet feeding roller 65 to a rear end of suction device 64, D represents a value of Lo−Lp. Since the a sucking duct is sucking constantly, sheet P is conveyed in the direction of X, a trailing edge of sheet P passes a rear end of suction device 64, and during the period for the trailing edge of sheet P to move through a range of D in the drawing, a succeeding sheet is sometimes sucked, causing multi-feeding.

Each of FIG. 7(*b*) and FIG. 8 represents an example of the invention, and it shows a structure to prevent this multi-feeding. Namely, in this example, suction device 64 is divided in the conveyance direction into two ducts including sucking duct 64*a* and sucking duct 64*b*. Further, on the sucking duct 64*b* positioned at the upstream side in the conveyance direction, there is provided suction intercepting member 64*c*. The suction intercepting member 64*c* is a plate-shaped one wherein a rotary shaft is provided at the center, the rotary shaft is protruded to the outside of sucking duct 64*b* to be rotated by solenoid SOL or a motor so that air flow for the sucking duct 64*b* is stopped or allowed. The solenoid SOL and the motor are controlled by controller 70. Further, sucking duct 64*a* and sucking duct 64*b* are gathered in one place as shown in FIG. 8, and suction fan 64*d* is provided on that place. The suction fan 64*d* is also controlled by the controller 70.

In the invention, an adjustment is made so that Lp representing a length of sheet P may be greater than Lk that represents a distance from a nip point of sheet feeding roller 65 to a rear end of sucking duct 64*a*, as shown in FIG. 7(*b*). The sheet P in this case is one whose length in the conveyance direction is shortest among sheets fed by sheet feeding tray LT.

Though the suction device 64 is divided into two portions, and suction fan 64*d* sucks by itself for both portions, it is also possible to provide a suction fan for each of sucking ducts 64*a* and 64*b* so that each suction fan may be rotated independently. Further, it is also possible to make suction fan 64*d* to be controlled in terms of its suction force through changing of a rotating speed.

As stated above, sucking duct 64*b* is closed by suction intercepting member 64*c*, and length Lp of sheet P is caused to be greater than Lk in FIG. 7(*b*). Therefore, as far as sucking duct 64*a* continues sucking sheet P, sucking duct 64*b* is closed, thus, succeeding sheet P is not sucked, resulting in prevention of multi-feeding.

With respect to the size of Lk, it may be set so that it is shorter than a length under which a length in the conveyance direction is minimum among sheets handled by sheet feeding tray LT. By doing this, it is not necessary to make sucking duct 64*a* and sucking duct 64*b* to be the same in terms of a length in the conveyance direction. Further, the invention is not limited to the structure to divide into two, and it is also possible to divide into three or more. In that case, a distance up to the end portion of the sucking duct on sheet trailing edge side that is positioned at the most downstream side in the conveyance direction, among Lks of respective sucking ducts becomes shorter than a length in the conveyance direction for the sheet having the minimum size. When dividing into three or more portions, sucking ducts are closed in succession, adjusting to sizes of sheets P, beginning with a sucking duct at the upstream side in the conveyance direction. Further, the suction intercepting member 64*c* is not always needed because a sucking duct positioned at the most downstream side in the conveyance direction sucks without fail.

When a size of sheet P is large, and relationship of Lo≦Lp holds, the suction intercepting member 64*c* is opened, and both of the sucking ducts 64*a* and 64*b* suck. By doing this, even large sheet P can be sucked sufficiently, and can be conveyed.

FIG. 9 is a block diagram showing the constitution of a control of a sheet feeding device, and FIG. 10 is a timing chart showing control of a sheet feeding device. Controller 70 is composed of a computer in which data of sheet sizes and sheet types (coated paper, thick paper, OHP film and glossy paper) are inputted, and on-off signals from sheet sticking detection sensor PS1, feed sensor PS2 and sheet height detection sensor PS3 are inputted. Based on these pieces of information, side blowing section 40, blowing section 50 and sticking and conveying section 60, intercepting member 45, suction intercepting member 64*c* and suction fan 64*d* are controlled.

After a sheet bundle is set in sheet tray 31 and sheet-feed starting information is inputted in a controller, an unillustrated elevating section rises through wind path 43, and side blowing section 40 starts blowing. Then, several sheets on the upper portion of the sheet bundle are blown up and sticking belt 63 of sticking and conveying section 60 sucks sheet P1. In this case, suction device 64 gives an instruction with controller 70 to suck whether with only sucking duct 64*a* depending on a size of sheet P or with either one of sucking ducts 64*a* and 64*b*. When sticking detection sensor PS1 detects that sticking belt 63 of sticking and conveying section 60 has sucked, controller 70 controls intercepting member 45 to switch operation of air blowing by side blowing section 40 to non-operation thereof.

Namely, during the period of time from the moment when sticking detection sensor PS1 (see FIG. 2) arranged in the vicinity of sticking belt 63 detects that sheet P1 has been sucked by sticking and conveying section 60 to the moment when the sticking and conveying section 60 starts feeding out sheet P1, the controller 70 causes intercepting member 45 to intercept an air inlet of side blowing section 40, and controls not to operate air blowing.

Further, when sticking detection sensor PS1 has detected that sheet P1 is sucked and feed sensor PS2 has not detected sheet P1, namely, only for the period before feeding out of sheet P1, intercepting member 45 is made to be in a patulous state, and air blowing is carried out.

Incidentally, a period of time for intercepting by intercepting member 45 does not need to be exactly the same as the aforesaid timing. However, if the intercepting time is limited only to the moment to start feeding out sheet P1, the intercepting time turns out to be extremely short, and an effect of separating sheet P1 is not obtained. Further, when sticking detection sensor PS1 detects that sheet P1 is sucked, if intercepting member 45 is intercepting constantly, sheet P1 is not sucked to sticking belt 63 because of insufficient pushing up by air, and sheet feeding troubles are sometimes generated. Namely, sheet feeding troubles are generated when the intercepting time is too long and is too short. As the best timing, solenoid SOL is turned on to close intercepting member 45 under the state before the start of sheet feeding where sticking detection sensor PS1 is in the state of on and feed sensor PS2 is in the state of off, for the first sheet P1, as shown in FIG. 10.

Sticking detection sensor PS1 is switched from on to off after the second sheet P2 is ejected out, then, feed sensor PS2 is turned off, and after an elapse of prescribed time, the sticking detection sensor PS1 is turned on by the third sheet P, and solenoid SOL is turned on to close intercepting member 45.

The foregoing is standard timing, and it is desirable to obtain optimum timing for sheet sizes and sheet types, and to cause a controller to store it, to control based on this stored data.

Blowing fan 42 can be controlled by a controller in terms of rotation, and airflow is controlled depending on a size, paper quality and basis weight of sheet P, so that optimum airflow may be blown. Thus, a certain specific sheet and airflow that is optimum for the specific sheet are stored in a controller of an image forming apparatus, in the same way as in the aforesaid timing of opening and closing for intercepting member 45. Sizes and paper quality of sheet P housed in a sheet tray can be stored through inputting on an operation section. By doing this, it is possible to set so that a controller can conduct air blowing suitable for paper quality constantly.

When replenishing sheet P, sheet tray 31 is drawn out of sheet feeding tray LT through guide rail 34. In this case, if wind path 43 is in its risen position, it interferes with sticking belt 63 of sticking and conveying section 60. Therefore, when drawing sheet tray 31 out, wind path 43 through blowing outlet 44 are lowered to their bottom positions by the elevating section, which is not illustrated. A bottom position of the blowing outlet 44 has only to be at the height where the wind path 43 does not interfere with conveying section 60 when sheet tray 31 is drawn out, and it does not always need to be lower than surface 41*b* at the downstream side of side regulating member 41, and it may also be higher than the surface 41*b* at the downstream side.

In the example of the invention, suction device 64 is divided into plural portions such as sucking ducts 64*a* and 64*b* as explained above, therefore, when a sheet size is large, the sheet is sucked by both of the divided sucking ducts 64*a* and 64*b*. Since sheet P is sucked by both of the divided sucking ducts 64*a* and 64*b*, it is possible to obtain necessary suction power, and thereby to suck sheet P surely to convey it. When a leading edge of sheet P is nipped, succeeding sheet P is not sucked because sucking ducts 64*a* and 64*b* are entirely covered.

When a size of sheet P is small, suction intercepting member 64*c* on sucking duct 64*b* located at the rear side in the conveyance direction is made to be in a closed state. Then, an arrangement is made so that a sucking duct (which is sucking duct 64*a* in the case of dual division) that is sucking is always closed by sheet P, when the leading edge of sheet P is nipped by sheet feeding roller 65. By doing this, it is possible to close a sucking duct at all times with sheet P when a leading edge of sheet P is nipped by sheet feeding roller 65, thus, suction of the second sheet is prevented and multi-feeding can be prevented.

Meanwhile, with respect to the sheet feeding device of the invention, it can also be applied to sheet cassette 10 arranged inside image forming apparatus main body A, although large capacity sheet feeding tray LT connected to the image forming apparatus main body A has been explained.

When a sheet size is large, a sheet is sucked by all of sucking ducts which are plural divided portions. Since the sheet is sucked by all sucking ducts, the sheet is sucked surely by obtaining necessary suction power to be conveyed. When a leading edge of the sheet is nipped by sheet feeding rollers, all of the sucking ducts are closed by the sheet, thereby, a succeeding sheet is not sucked.

When a sheet size is small, necessary number of sucking ducts beginning with a sucking duct positioned at the rearmost position in the conveyance direction toward the front are made to be in the state where the suction intercepting members are closed in succession, and the sheet is sucked by residual sucking ducts. The sheet sucked by a sticking and conveying section is conveyed, and its leading edge is nipped by sheet feeding rollers. In this case, sucking ducts which suck so that all sucking ducts may be closed by the sheet are determined. By doing this, when a leading edge of the sheet is nipped by sheet feeding rollers, all of the sucking ducts can be closed by the sheet, thereby, suction of the second sheet is prevented and multi-feeding can be prevented.

What is claimed is:

1. A sheet feeding device structured to feed an uppermost sheet from a sheet bundle including a plurality of sheets, the uppermost sheet having a length Lp in a sheet conveyance direction, the sheet feeding device comprising:

(a) a sheet feeding tray adapted to stack the sheet bundle thereon;

(b) a blowing section which blows air against a leading edge of the sheet bundle in the sheet conveyance direction from a front side of the sheet conveyance direction;

(c) a sticking and conveying section which sticks the uppermost sheet stacked on the sheet feeding tray by air sucking, and feeds the uppermost sheet to a conveyance roller;

(d) a sucking duct provided inside the sticking and conveying section, which is divided into a plurality of ducts in the sheet conveyance direction; and (e) an intercepting member which intercepts air of a sucking duct provided on an upstream side in the sheet conveyance direction among the sucking duct which has been divided into the plurality of ducts, to stop sucking of the air;

(f) a side blowing section which blows air against a side of the sheet bundle from a side direction perpendicular to the sheet conveyance direction;

(g) a sheet sticking detection sensor which detects that the sheet is sucked to the sticking and conveyance section; and (h) a controller which controls blowing of the air from the side blowing section, wherein the following expression is satisfied:

$$Lk<Lp$$

where Lk represents a distance between a nip point of the conveyance roller and an end on a leading edge side in the sheet conveyance direction of a duct which is intercepted by the intercepting member, that is provided on a most upstream side in the sheet conveyance direction among the plurality of divided ducts, Lo represents a distance between the nip point of the conveyance roller and a rear end of the duct that is provided on the most upstream side among the plurality of divided ducts, and in case of $Lo \geqq Lp$, the intercepting member intercepts the duct provided on the upstream side, which is divided so that $Lk<Lp$ is satisfied, and wherein when the sticking detection sensor detects the sheet, the controller stops the blowing of the air from the side direction by the side blowing section.

2. The sheet feeding device of claim 1, wherein the sucking duct is divided into two sucking ducts.

3. The sheet feeding device of claim 1, wherein a common sucking fan is connected to the plurality of divided sucking ducts.

4. The sheet feeding device of claim 1, wherein a number of rotations of a common sucking fan is capable of being changed.

5. An image forming apparatus structured to form a toner image onto an uppermost sheet from a sheet bundle including a plurality of sheets, the uppermost sheet having a length Lp in a sheet conveyance direction, the image forming apparatus comprising:

(a) an image forming section which forms the toner image on an image carrier;

(b) a transfer section which transfers the toner image on the image carrier onto the uppermost sheet;

(c) a sheet feeding device which conveys the sheet to the transfer section; and (d) a fixing device which fixes the toner image transferred onto the sheet by heating the sheet, wherein the sheet feeding device comprises (1) a sheet feeding tray adapted to stack the sheet bundle thereon;

(2) a blowing section which blows air against a leading edge of the sheet bundle in the sheet conveyance direction from a front side of the sheet conveyance direction;

(3) a sticking and conveying section which sticks the uppermost sheet stacked on the sheet feeding tray by air sucking, and feeds the uppermost sheet to a conveyance roller;

(4) a sucking duct provided inside the sticking and conveying section, which is divided into a plurality of ducts in the sheet conveyance direction; and (5) an intercepting member which intercepts air of a sucking duct provided on an upstream side in the sheet conveyance direction among the sucking duct which has been divided into the plurality of ducts, to stop sucking of the air, (6) a side blowing section which blows air against a side of the sheet bundle from a side direction perpendicular to the sheet conveyance direction;

(7) a sheet sticking detection sensor which detects that the sheet is sucked to the sticking and conveyance section; and (8) a controller which controls blowing of the air from the side blowing section, wherein the following expression is satisfied:

$$Lk<Lp$$

where Lk represents a distance between a nip point of the conveyance roller and an end on a leading edge side in the sheet conveyance direction a of a duct which is intercepted by the intercepting member, that is provided on a most upstream side in the sheet conveyance direction among the plurality of divided ducts, Lo represents a distance between the nip point of the conveyance roller and a rear end of the duct that is provided on the most upstream side among the plurality of divided ducts, and in case of $Lo \geqq Lp$, the intercepting member intercepts the duct provided on the upstream side, which is divided so that $Lk<Lp$ is satisfied, and wherein when the sticking detection sensor detects the sheet, the controller stops the blowing of the air from the side direction by the side blowing section.

* * * * *